United States Patent [19]

Ricodeau et al.

[11] Patent Number: 5,028,842

[45] Date of Patent: Jul. 2, 1991

[54] DEVICE FOR CHROMATIC CONVERSION OF AN IMAGE OBTAINED BY ELECTROMAGNETIC RADIATION AND MANUFACTURING PROCESS THEREOF

[75] Inventors: Jean Ricodeau, Saint Egreve; Maurice Verat, Saint Martin Le Vinoux; Gilbert Colomb, Voiron, all of France

[73] Assignee: Thomson-CSF, Puteaux, France

[21] Appl. No.: 327,029

[22] Filed: Mar. 22, 1989

[30] Foreign Application Priority Data

Mar. 22, 1988 [FR] France ..... 88 03684

[51] Int. Cl.[5] ..... H01J 31/50

[52] U.S. Cl. ..... 313/525; 313/529; 313/530; 313/544

[58] Field of Search ..... 313/529, 530, 541, 542, 313/544, 525; 250/213 VT

[56] References Cited

U.S. PATENT DOCUMENTS

| | | | |
|---|---|---|---|
| 3,280,356 | 10/1966 | Stoudenheimer et al. . | |
| 4,087,683 | 5/1978 | Lieb | 313/530 |
| 4,423,351 | 12/1983 | Sugimori et al. | 313/541 |
| 4,717,860 | 1/1988 | Christgau et al. | 313/544 |
| 4,874,987 | 10/1989 | Van der Eijk et al. | 313/544 |

FOREIGN PATENT DOCUMENTS

| | | |
|---|---|---|
| 0173851 | 3/1986 | European Pat. Off. . |
| 0187258 | 7/1986 | European Pat. Off. . |
| 0258940 | 3/1988 | European Pat. Off. . |
| 2003856 | 11/1969 | France . |
| 2111030 | 5/1972 | France . |
| 2497400 | 7/1982 | France . |

OTHER PUBLICATIONS

Patent Abstracts of Japan, vol. 10, No. 197 (E-418) [2253], Jul. 10, 1986; JP-A-61 42 842 (NEC Corp.) 01-03-1986.

*Primary Examiner*—Donald J. Yusko
*Assistant Examiner*—Diab Hamadi
*Attorney, Agent, or Firm*—Oblon, Spivak, McClelland, Maier & Neustadt

[57] ABSTRACT

A vacuum-tight envelope (601) having a terminal element (610) bearing the envelope's output window. An output screen (605) is glued to the inner face of the output window by a first glue (608) having the same refractive index as the output window. The envelope's terminal element is made unitary with a (611) of the envelope by vacuum-tight mounting (609). An optional anti-reflection coating (674) may be deposited directly onto the external face of the output window.

23 Claims, 5 Drawing Sheets

DEVICE FOR CHROMATIC CONVERSION OF AN IMAGE OBTAINED BY ELECTROMAGNETIC RADIATION AND MANUFACTURING PROCESS THEREOF

BACKGROUND OF THE INVENTION

1. Field of the Invention

The present invention concerns the chromatic conversion of an image obtained by electromagnetic radiation. More particularly, but not exclusively, it addresses the field of radiology for the conversion of an x-ray image into a visible light image.

2. Discossion of the Background

FIG. 1 is a longitudinal cross-sectional view of a prior art device for the chromatic conversion of an x-ray image, showing the main constituent elements. The device T, also known as an x-ray intensifier tube XRIT, comprises a gas-tight envelope 1 having a surface of revolution 1, inside which is created a vacuum. The vacuum envelope 1 has an input faceplate 2 that is transparent to ionising radiation. Behind the faceplate 2 is located a photoelectric input screen 3 intended to receive the ionising radiation. In response to this ionising radiation, the photoelectric screen 3 emits electrons along electron trajectories 7. At the opposite end to the input faceplate 2 is located an output window 4 whose inner face contains an output phosphor screen 5 intended to receive the electrons and produce visible light in response therefrom by cathodoluminescence. The output window 4 is transparent to the radiation from the phosphor, thus allowing the derived image to be viewed.

The envelope 1 also contains focusing means 6, joined thereto by supports 64, for focusing the electrons emitted by the input screen 3 toward output screen 5. The focusing means 6 comprise a final electrode 60—also known as an anode—which can be brought to the same potential as the output screen 5 when the device is in operation, as well as a pre-terminal electrode 61 located in the region of the final electrode 60 and further removed from the output screen 5 than the latter. The focusing means 6 also comprise a set of electrodes 60 located between the pre-terminal electrode 61 and the input window 3.

FIG. 2, which also illustrates the prior art, is a partial longitudinal cross-section showing schematically first arrangement for fixing the output screen 5 with respect to the output window 4. The output window is formed of a transparent, or semi-transparent, plate 51 (transparency on the order of 0.8), generally made of glass, covered with a phosphor layer 50 that converts the energy of the incoming electrons. In general, this phosphor layer 50 is formed of a concentration of very small size grains. The plate 51 is normally tinted and its typical dimensions are on the order of 45 mm for the diameter and 0.6 mm for the thickness. The output screen 5 is separated from the output window 4 by a shell 53 such that a vacuum cavity 52 with parallel faces is formed between the plate 51 and the output window 4. However, this vacuum cavity 52 has a detrimental effect on the output image contrast. For this reason, it was eliminated in the output screen fixing arrangement shown in FIG. 3, which also illustrates the prior art. In this figure, the elements corresponding to—or having corresponding functions to—those of FIG. 2 are given references increased by 100 with respect to the latter. Only the differences between the figures shall discussed hereafter.

In the fixing arrangement of FIG. 3, the output screen 105 serves as an output window. The plate 151 bearing the phosphor layer 150 is relatively thick (on the order of 2.5 mm) in order to withstand the external pressure. This plate 151 is fitted with a mounting element 154 soldered by a string of solder 155 to a similar fixing element 112 forming part of the envelope 101. A first manufacturing step for this device would consist in depositing the phosphor layer 150 on the glass plate 151 and then soldering the glass plate 151 to the envelope 101.

However, this fixing arrangement has a number of drawbacks. Indeed, although the size of the plate 151 bearing the phosphor layer 150 is reduced, it is still too large and increases manufacturing costs, especially since this plate 151 must be sufficiently thick to withstand the external pressure. Furthermore, the output screen is brought to a very high voltage (around 30 kilovolts), and the mounting elements 154, 155 and 112 must be isolated from the outside environment by means of a substantial and complete insulating resin potting (not shown in FIG. 3). The constraints regarding the mechanical mount, the very-high voltage insulation, optical image relaying and manufacturing costs of the phosphor layer 150 are not all compatible with each other, and thus the optimum compromise for the whole system is not optimized for each aspect, with detrimental effects on costs.

Moreover, it is difficult to deposit an anti-reflection coating 174 on the external face of the output window, owing to its fragility. The procedure thus involves gluing an additional plate 173 onto the external face of the output screen 105 using a glue 172 having the same refractive index as both the plate 151 and the additional plate 173 so as obtain a uniform refractive index between the phosphor layer 150 and the anti-reflection coating 174. The anti-reflection coating 174, being fragile, is deposited only at the last stage of the product's manufacturing process.

There results a considerable increase in the number of successive operations in the device's manufacturing process, which again increases costs. Moreover, should the anti-reflection coating 174 become scratched, repairs are impossible without damaging the potting, which risks destroying the envelope 101.

To overcome these disadvantages, frequent use is made of the fixing arrangement shown in FIG. 4, which is also prior art. In the latter figure, elements that are similar to—or have similar functions to—those of FIG. 3 have references increased by 100 with respect to the latter. Only the differences between the two figures shall be described.

In this fixing arrangement, the phosphor layer 250 is deposited on a thin, light plate 251 having relatively reduced dimensions. This plate 251 is then held in optical contact with the internal face 240 of the output window 204 by means of a glue 208 having the same refractive index as both the plate 251 and the output window 204. Image contrast is consequently improved in comparison with the fixing arrangement of FIG. 2. A narrow passage 230 is provided in the envelope to accommodate a conductor 231 for supplying the very-high voltage to the screen, thus obviating the need for a complete potting.

On the other hand, the output screen 205 must be glued directly onto the internal face 240 of the output window 204. This creates manufacturing problems since the envelope has relatively large dimensions (height on the order of 200 to 400 mm) while the output window is located at the bottom of a shrunken portion of the envelope 201 whose average height and diameter are on the order of 50 mm and 80 mm respectively.

Moreover, should it be desired to deposit an anti-reflection coating 274 on the outside of the envelope 201, it is preferable to do so on an additional plate 273 glued onto the output window 204 by means of the glue 272 in order to avoid having to handle an assembled envelope of large dimensions.

The vast majority of optical assemblies used for viewing the optical image delivered by x-ray image intensifier tubes are set for an image behind a glass plate approximately 3.5 mm thick. However, new optical assemblies that are optimized for a plate thickness of at least 8 to 10 mm are being developed in view of improving image contrast. Their utilization means having to thicken either the plate 251 bearing the phosphor layer 250, or the output window 204, or the additional plate 273 bearing the anti-reflection coating. Owing to constraints regarding the production of the phosphor layer 250, it is undesirable to increase the thickness of its support plate 251. The same applies for the output window 204 when dealing with a generally large-size envelope 201. One solution would be to thicken the additional plate 273 supporting the anti-reflection coating 274. However, this has the drawback of making the additional plate 273 heavy, making it more prone to ungluing in the event of thermal or mechanical shocks. Moreover, with the fixing arrangement described in FIG. 3, the output screen 105 tends to be heavy and the mounting elements 154 must be designed in consequence while respecting the very-high voltage insulation requirements. This further increases manufacturing complexity and hence costs.

SUMMARY OF THE INVENTION

Accordingly, one object of the present invention is to overcome these disadvantages by proposing a solution tending to reduce the manufacturing costs of such devices.

Another aim of the present invention is to enable the anti-reflection coating to be deposited directly onto the external face of the envelope's output window.

Yet another aim of the present invention is to open the possibility for manufacturing devices having a thick output window, that is simple to implement and does not prohibit the addition of an optional anti-reflection coating.

The subject of the present invention is therefore a device for chromatic conversion of an image obtained in the form of electromagnetic radiation, and in particular for passing from an ionizing radiation to visible light, comprising a vacuum-tight envelope having:

an input window that is transparent to electromagnetic radiation, behind which is located a photoelectric input screen destined to receive the electromagnetic radiation, and an output window on whose internal face is located a phosphor output screen, the output window being transparent to the radiation from the phosphor, as well as focusing means joined to the envelope for focusing the electrons emitted by the input screen toward the output screen, characterized in that the output window, on the internal face of which is glued the output screen by means of a first glue having an refractive index identical to that of the output window, forms part of a terminal element of the envelope made unitary with the rest of the envelope by a vacuum-tight mounting means.

In accordance with a number of embodiments of the invention, the terminal element is a dish having a substantially flat base forming the output window, with the lateral wall of the dish splaying out from the base, a first part of the mounting means being located in the region of the free extremity of the lateral wall while a second part of the mounting means is located in the region of the free extremity of the remainder of the envelope.

The lateral wall of the dish may be a truncated cone and the first mounting means may be a first metallic ferrule while the second part of the mounting means may be a second metallic ferrule having a portion protruding inside the envelope once the latter is assembled. The pre-terminal focusing electrode may thus be affixed to the protruding portion of the second metallic ferrule.

In certain other embodiments of the invention, the lateral wall of the dish comprises a first truncated conical portion joined to the base of the dish and a second truncated conical portion having a wider splay than the first truncated conical portion.

The second truncated conical portion advantageously comprises at least one narrow pre-terminal duct intended to receive a pre-terminal conductor element destined to supply the voltage to one electrode of the focusing means, the coexistence between the conductor element and its duct not being detrimental to the airtightness of the envelope.

The first and second parts of the mounting means may be soldered together to form the mounting means. The latter may equally be formed by a glued joint making the dish unitary with the rest of the envelope.

Advantageously, the lateral wall of the dish connected to the base comprises at least one narrow duct intended to receive a terminal conductor element destined to convey the very-high voltage, the coexistence between the conductor element and its duct not being detrimental to the airtightness of the envelope. In this case, the terminal electrode may be supplied by the terminal conductor element and may also be affixed to the latter.

In another embodiment of the invention, the terminal element is the output window. In this case, the mounting means consist of a glued joint.

Most advantageously, the terminal electrode is affixed to the pre-terminal electrode by means of electrically insulating fasteners.

In all embodiments of the device in accordance with the invention, an anti-reflection coating may be deposited in optical contact with the external face of the output window, which may be substantially thick.

The anti-reflection coating may be deposited either directly onto the external face of the output window or else on one of the faces of an additional plate that is transparent to the phosphor's radiation, the additional plate being in optical contact with the external face of the output window by means of a second glue having the same refractive index as the first glue.

The additional plate may be made either of glass or plastics material.

The invention also concerns a manufacturing process for a device for chromatic conversion of an image obtained by electromagnetic radiation, and in particular for passing from ionizing radiation to visible light, in which process:

a) a vacuum envelope is formed, consisting of:

an input window that is transparent to electromagnetic radiation, behind which is located a photoelectric input screen intended to receive the electromagnetic radiation, and an output window as well as focusing means, joined to the vacuum envelope to focus photoelectrons emitted by the input screen toward an output window, b) a phosphor output screen is formed and affixed onto the internal face of the output window, characterized in that the envelope is formed from two elements, including one terminal element comprising the output window, and in that, in step b) the phosphor output screen is affixed to the internal face of the output window by means of a first glue having the same refractive index as the output window, and in that—the terminal element is then made unitary with the rest of the envelope by vacuum-tight mounting means.

Advantageously, the anti-reflection coating is deposited in optical contact with the external face of the output window before the terminal element is made unitary with the rest of the envelope.

BRIEF DESCRIPTION OF THE DRAWINGS

Other advantages and characteristics of the invention shall become apparent from the detailed description given hereafter as well as in the appending diagrams, in which.

DESCRIPTION OF THE PREFERRED EMBODIMENTS

Figures that mainly contain characteristic elements shall serve not only to help better understand the invention, but also to contribute, if needs be, to the definition of the invention.

Figure 1:
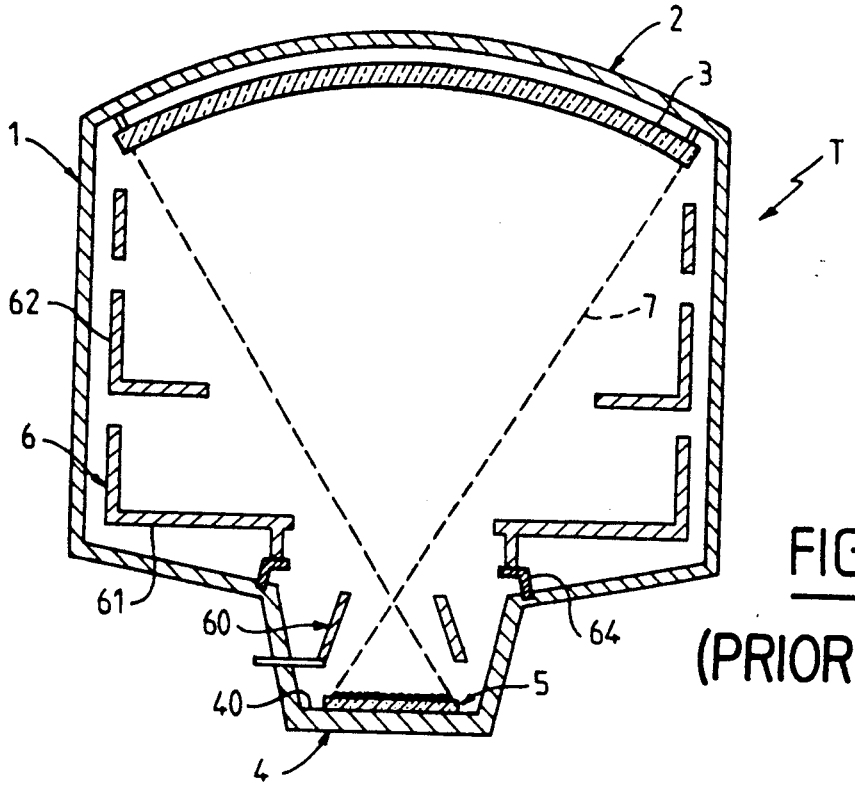
FIG. 1 (PRIOR ART)
FIG. 1 already described, is a schematized longitudinal cross-section of a prior art device, FIG. 2, already described, is a schematized partial longitudinal cross-section of a first prior art arrangement for fixing an output screen onto an output window, FIG. 3, already described, is a schematized partial longitudinal cross-section of a second prior art arrangement for fixing an output screen onto an output window, FIG. 4, already described, is a schematized partial longitudinal cross-section of a third prior art arrangement for fixing an output screen onto an output window.
Figure 2:
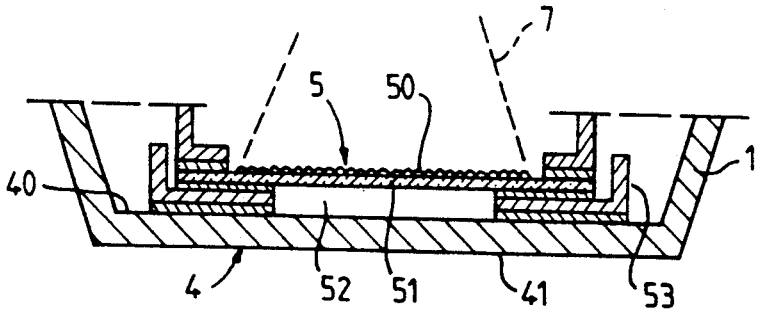
FIG. 2 (PRIOR ART)
Figure 5:
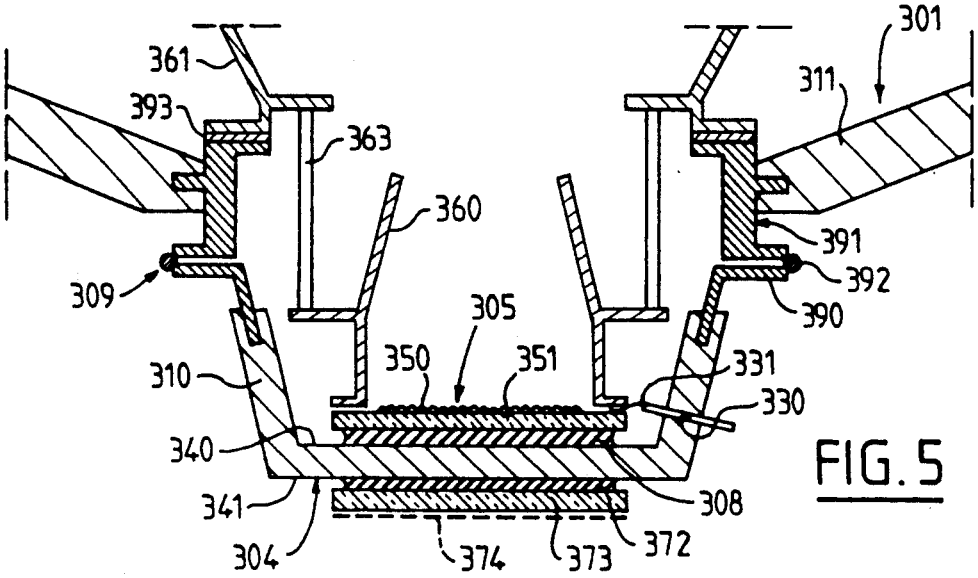
FIG. 5 is a schematized partial longitudinal cross-section of a first embodiment of the device in accordance with the invention.

Elements shown in FIG. 5 that are analogous to—or have analogous functions to—those of FIGS. 1 and 2 (respectively 4), are given references increased by 300 (respectively 100) with respect to those they were given in FIGS. 1 and 2 (respectively 4). Only the differences between FIG. 5 and the above-mentioned figures shall be discussed.

The envelope 301 is formed of a terminal portion 310 joined to the rest 311 of the envelope by mounting means 309. The terminal portion 310 is a dish the base wall of which is substantially flat and forms the output window 304. The lateral wall of the dish 310 is a truncated cone that splays out from the base wall 304. In the region of the free edge of the lateral wall is attached a first part of the mounting elements 309, consisting of a first metallic ferrule 390. In the region of terminal portion 310 of the rest 311 of the envelope 301 is located a second metallic ferrule 391, forming a second part of the mounting means 309. The second metallic ferrule 391 has a part 393 protruding inside the envelope 301 once the latter is assembled. The ferrules 390 and 391 are soldered together by means of a line of solder 392, thus forming the mounting means 309.

The pre-terminal electrode 361 is affixed to the protruding portion 393 of the second metallic ferrule 391. The pre-terminal electrode 361 supports the terminal electrode 360 via electrically insulating fastening elements 363. A narrow terminal duct 330 is provided in the lateral wall of the dish 310. Inside the duct is lodged a metallic terminal conductor 331 to supply the very-high voltage to both the terminal electrode 360 and the output screen 305. The coexistence of the conductor 331 and the duct 330 is not detrimental to the airtightness of the envelope 301. The use of the electrical conductor 331 avoids the very-high voltage insulation problems and, in particular, obviates the need of an overall potting deposited on the output screen, as is the case with certain prior art devices previously described.

The output screen 305 is glued to the internal face of the output window 304 by means of a first glue 308, hereafter referred to as first glue, having the same refractive index as both the output screen 305 and the output window 304.

An anti-reflection coating 374 is deposited on an additional plate 373, which is glued to external face 341 of the output window 304 by means of a second glue 372, referred to hereafter as second glue. The dish depth, being on the order of a few cm, and the greatest dish diameter, being on the order of 10 cm, make it relatively easy to glue the output screen 305 to the internal face of the output window 340. Similarly, the inspection and subsequent storage of the dish 310, being carried out separately from the more cumbersome remainder 311 of envelope 301, are simplified. Moreover, the closure of the envelope 301 by the line of solder 309 may be performed at the last stage after assembly of the other elements.

More generally, a figure number n greater than or equal to 6, showing elements that are analogous to—or having analogous functions to—those of a figure n−1, shall bear figure references increased by 100 with respect to the latter. Only differences between a figure n and a figure n−1 shall be described.

Figure 3:
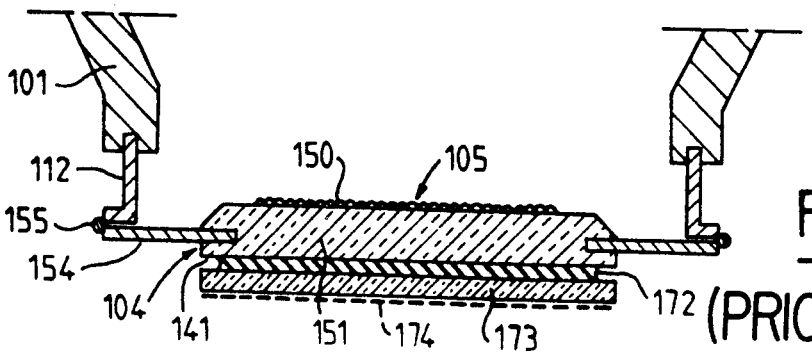
FIG. 3 (PRIOR ART)
Figure 4:
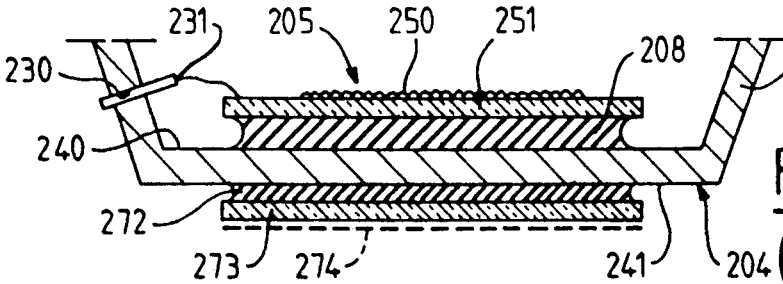
FIG. 4 (PRIOR ART)
Figure 6:
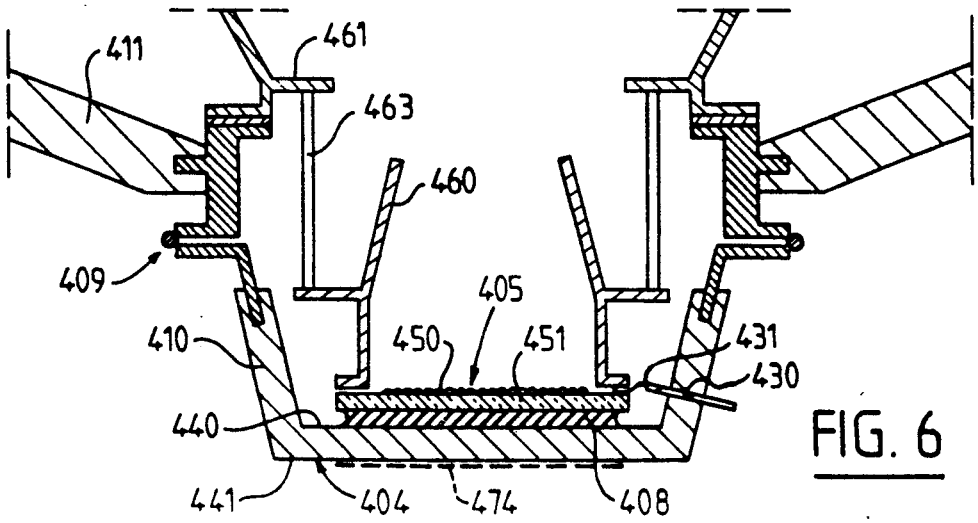
FIG. 6 is a schematized partial longitudinal cross-section of a second embodiment of the device in accordance with the invention.

In FIG. 6, the anti-reflection coating 474 is deposited directly onto the external face 441 of the output window 404. This step is made possible with the device in accordance with the present invention, in contrast with the above-described prior art devices. Indeed, according to the present invention, the output window 404 bearing the anti-reflection coating 474 need not be submitted to the manufacturing operations for the phosphor output window (as is the case with the arrangement of FIG. 3). Likewise, the anti-reflection coating 474 step need not be performed on a large, complete envelope (as is the case with the arrangement of FIG. 4).

Figure 7:
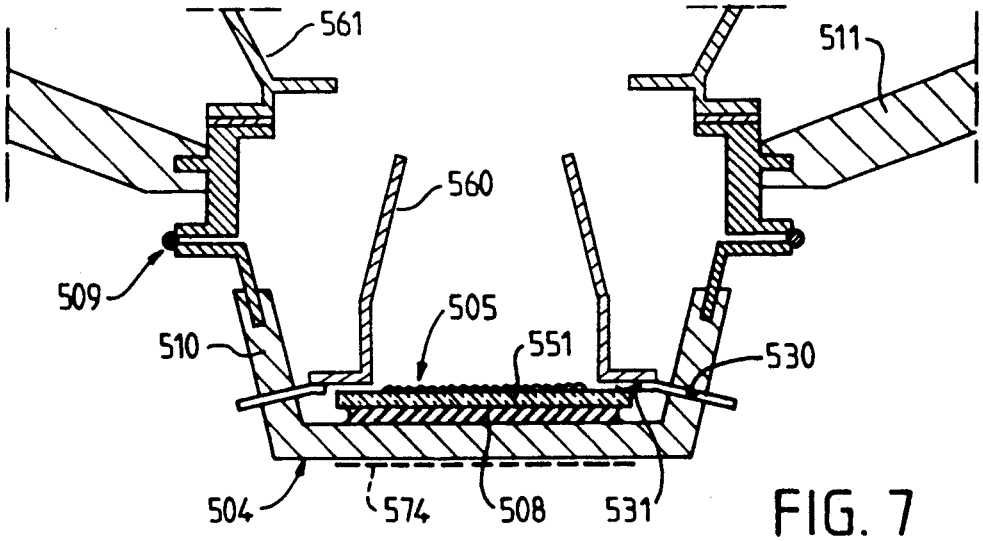
FIG. 7 is a schematized partial longitudinal cross-section of a third embodiment of the device in accordance with the invention.

In FIG. 7, the conductor terminal 531, lodged inside the terminal duct 530, is rigid and thus not only supplies the terminal electrode, but also serves as a mount for the latter.

Figure 8:
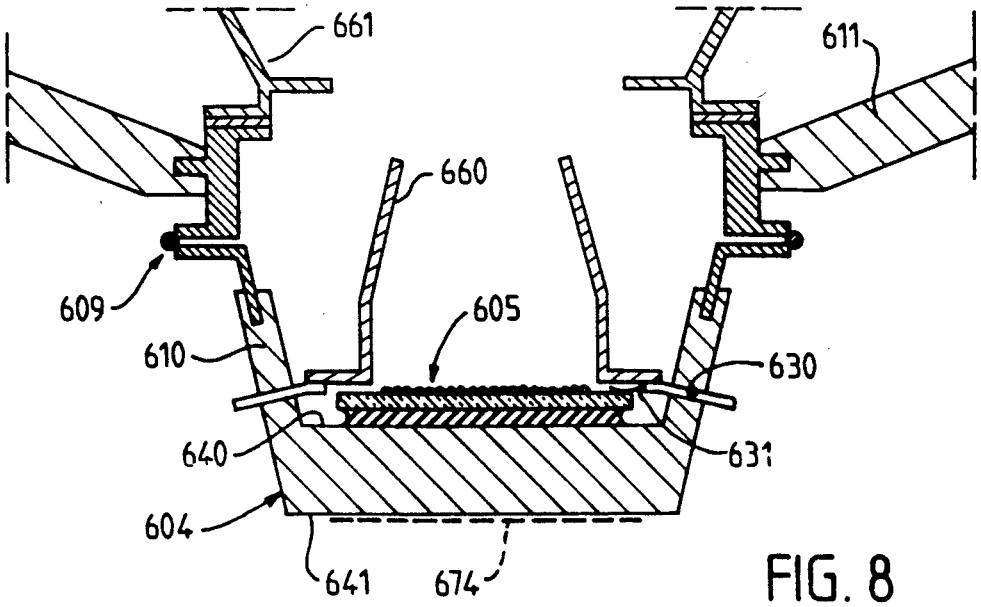
FIG. 8 is a schematized partial longitudinal cross-section of a fourth embodiment of the device in accordance with the invention.

FIG. 8 shows a partial longitudinal cross-section of a device in accordance with the invention, wherein the output window 604 thickness is on the order of 10 mm. Whereas thickening the output window causes weight and very-high voltage insulation problems with the above-described prior art devices, the use of a terminal element 610 that is distinct from the rest of the envelope—and thus of smaller size—overcomes this problem by simply thickening the output window 604.

Figure 9:
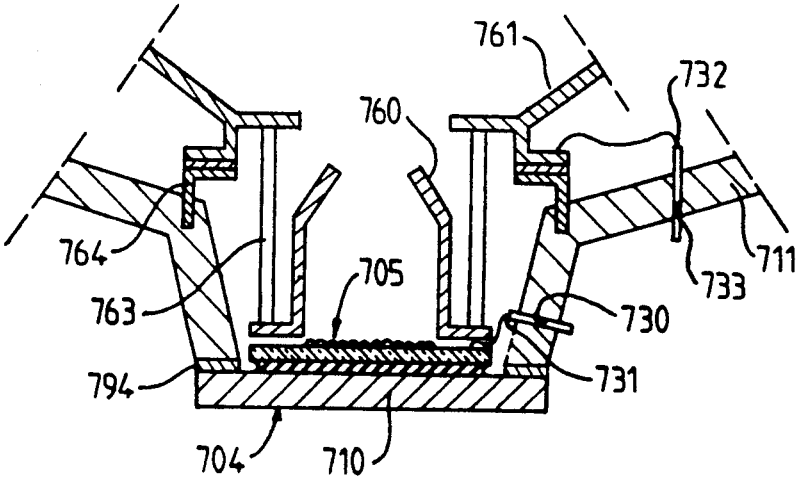
FIG. 9 is a schematized partial longitudinal cross-section of a fifth embodiment of the device in accordance with the invention.

In the embodiment of the invention in accordance with FIG. 9, the terminal element 710 forms the output window 704. The output window 705 is then glued directly to the rest 711 of the envelope 701 by a glued joint 794. One of the suitable glues belongs to the polyimide group. These glues remain stable at 280 degress Celcius, which is the temperature attained in XRIT tubes in manufacturing stages after gluing. The glued joint is vacuum tight and does not emit gas in composition or quantity that would impair the proper function or lifetime of the device in accordance with the invention. Such an embodiment obviates the need for metallic pieces such as the first and second ferrules (FIGS. 1 to 8) which, in operation, are brought to relatively high pre-terminal electrode voltages. Although this voltage is well below that of the final electrode, it nevertheless requires external insulation. The use of the glued joint avoids the need for such insulation. The voltage supply to the pre-terminal electrode can then be achieved by a metallic pre-terminal conductor 732—analogous to the terminal conductor 731—that is lodged in a narrow pre-terminal duct 733. There again, the coexistence of the duct 733 and the conductor 732 is not detrimental to the airtightness of the envelope. The terminal electrode 760 is connected to the pre-terminal electrode 761 by electrically insulating fastening means 763 whereas the pre-terminal electrode 761 is connected to the envelope 711 via a classical fixing means 764 of the type 64 shown in FIG. 1.

Figure 10:
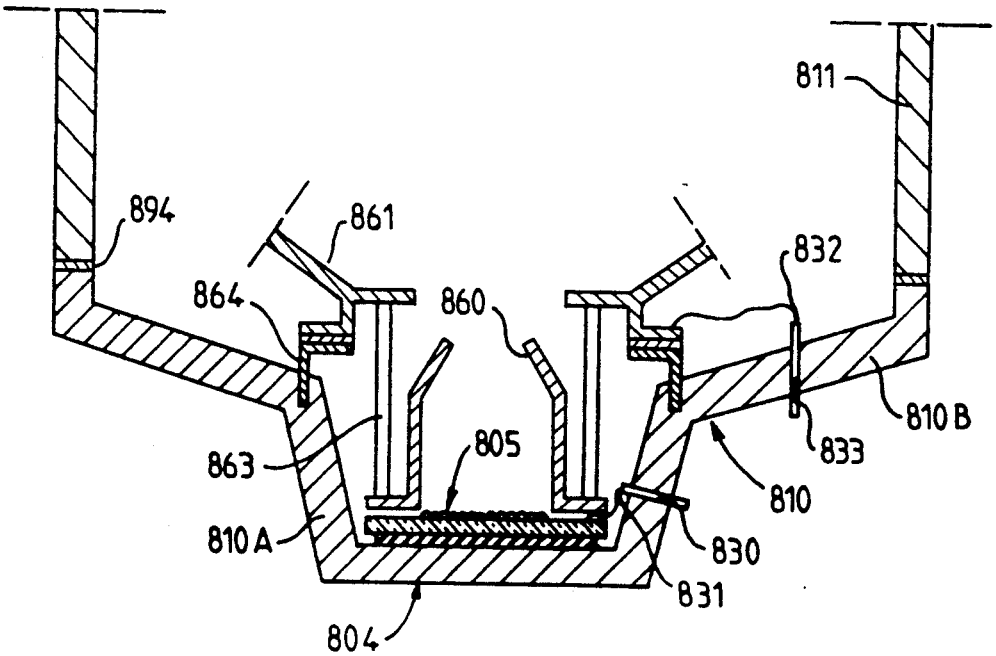
FIG. 10 is a schematized partial longitudinal cross-section of a sixth embodiment of the device in accordance with the invention.

In the embodiment of FIG. 10, the terminal element 810 is dish shaped, wherein the first truncated conical portion 810A joined to the base is extended by a second truncated conical portion 810B having a wider splay. The dish is made unitary with the rest 811 of the envelope by a glued joint 894 of the type described in the embodiment of FIG. 9. The duct 833 that receives the conductor 832 is provided in the second truncated conical portion 810B. The dish 810 remains shallow (on the order of 50 mm) and is compatible with an easy assembly and gluing of the output screen 805.

Figure 11:
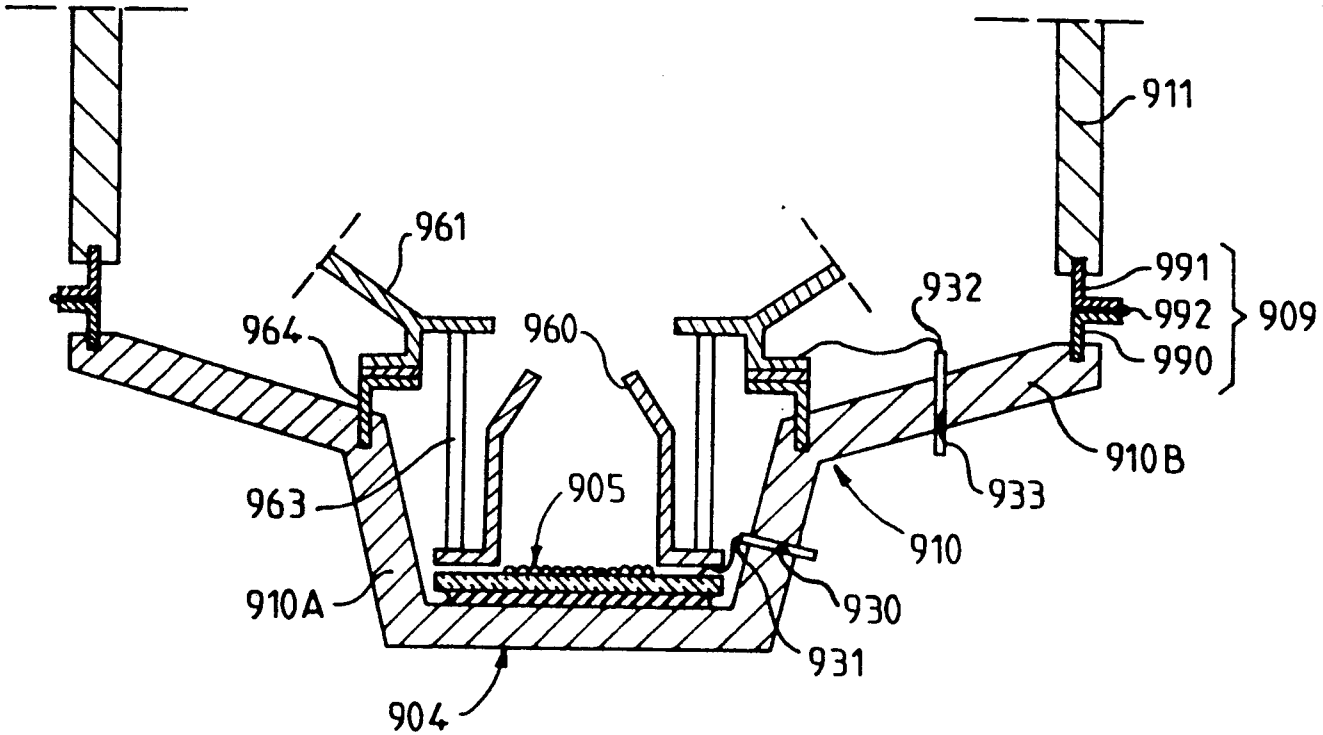
FIG. 11 is schematized partial longitudinal cross-section of a seventh embodiment of the device in accordance with the invention.

In the embodiment of FIG. 11, the means for mounting the dish 910 on the rest 911 of the envelope are identical to those used for a dish having one single truncated conical portion (FIGS. 5 to 8), i.e. they consist of a first metallic ferrule 990, and a second metallic ferrule 991 connected to the rest 911 of the envelope by a line of solder 992 joining the two above-mentioned metallic ferrules 990 and 991. As the pre-terminal electrode is supplied by the said conductor 932, the metallic ferrules 990 and 991 are at a very low voltage corresponding to that of a focusing electrode located upstream of the pre-terminal electrode. This voltage is typically on the order of 100 to 200 Volts, or even zero, and does not therefore result in insulation problems outside the envelope.

In all of the above-described embodiments, the anti-reflection coating may be deposited either directly onto the external face of the output window or onto an additional plate glued to the external face of the output window by means of the second glue.

The intermediate plate may be made of either glass or plastics material. Whichever the case, the actual transparent material used will obviously be chosen such as to obtain a uniform refractive index between the phosphor layer and the anti-reflection coating. This refractive index, common to the phosphor layer substrate, first and second glues, output window and optionally the additional plate, is on the order of 1.5.

Similarly, in all of the above-described embodiments, use can be made of means cescribed specifically in one embodiment but which prove to be common to all. This is particularly the case for the thick output window and/or the electrically insulating fastening means, or again the use of rigid conductors supporting the terminal electrode.

All the above-described embodiments offer the advantage of a simplified and less costly manufacturing process compared with prior art methods. Indeed, once the output screen is produced, it is glued to the internal face of the terminal element's output window. This step is facilitated by the small size of the terminal element. The latter is then assembled to the envelope by means of the vacuum-tight mounting devices. This avoids having to glue the output screen at the bottom of a relatively deep cavity formed by the complete envelope.

Moreover, when an anti-reflection coating needs to be deposited, it can be applied before assembling the terminal element to the rest of the envelope, which avoids having to handle a large envelope. In the case where an additional plate is used, the absence of an overall potting (FIG. 3) gives the possibility of removing the additional plate, should the anti-reflection coating be damaged, and of re-inserting it once the envelope is assembled.

Naturally, the invention is not restricted to the above-described embodiments, but covers any other variant.

For instance, at least one of the following may be tinted: the phosphor substrate, output window, or additional plate. Also, several narrow ducts may be provided to supply the focusing means. Again, the materials transparent to the various forms of radiation may be selected among any material compatible with the device's manufacturing and operating conditions, and having the required transparency.

Finally, some of the above-described means may be omitted in variants where they are not necessary.

What is claimed is:

1. Device for chromatic conversion of an image obtained in the form of electromagnetic radiation, and in particular for passing from an ionizing radiation to visible light, comprising a vacuum-tight envelope (301) comprising:

an input faceplate that is transparent to electromagnetic radiation, behind which is located a photoelectric input screen destined to receive the electromagnetic radiation, and focusing means (360, 361) joined to the envelope for focusing photoelectrons emitted by the input screen toward an output screen, an output window (304) that is transparent to the radiation from the phosphor (350) and on whose internal face (340) is glued an output phosphor screen (305) by means of a first glue (308) having the same refractive index as said output window (304)

characterized in that said output window (304) forms part of a terminal element (310) of the vacuum-tight envelope (301), made unitary with a rest (311) of said envelope by mounting means (309) that are vacuum tight and remote from the output image plane;

said terminal element (310) characterized in that it is made of eletrically insulating material that is transparent to the phosphor radiation, and in that it has the form of a dish having a substantially flat base forming the output window, the lateral wall of the dish splaying out from the base, and in that a first part of the mounting means is located in the region of the free extremity of the lateral wall while a second part of the mounting means is located in the region of the free extremity of the remainder of the envelope.

2. Device according to claim 1, characterized in that the lateral wall of the dish (310) is a truncated cone.

3. Device according to claim 2, characterized in that the first part of the mounting means is a first metallic ferrule (390) while the second part of the mounting means is a second metallic ferrule (391) having a portion (393) protruding inside the envelope (301) once the latter is assembled.

4. Device according to claim 3, characterized in that the focusing means comprise a pre-terminal focusing electrode (361) affixed to the protruding portion (393) of the second metallic ferrule (391).

5. Device according to claim 1, characterized in that the lateral wall of the dish (810) comprises a first truncated conical portion (810A) joined to the base (804) of the dish, continued by a second truncated conical portion (810B) having a wider splay than the first truncated conical portion (810B).

6. Device according to claim 5, characterized in that the second truncated conical portion (810B) comprises at least one narrow pre-terminal duct (833) intended to receive a pre-terminal conductor element (832) destined to supply voltage to one electrode of the focusing means, the coexistence between the conductor element (832) and its duct (833) not being detrimental to the airtightness of the envelope.

7. Device according to claim 1, characterized in that the first and second parts of the mounting means are soldered together (392) to form the mounting means (309).

8. Device according to claim 1, characterized in that the mounting means are formed by a glued joint (894) making the dish (810) unitary with the rest (811) of the envelope.

9. Device according to claim 1, characterized in that the truncated conical wall of the dish joined to the base has at least one narrow duct (330) intended to receive a terminal conductor element (331) destined to convey the very-high voltage, the coexistence between the conductor element and its duct not being detrimental to the airtightness of the envelope.

10. Device according to claim 9, characterized in that the focusing means comprise a terminal electrode (360) supplied by the terminal conductor element (331) and also affixed to the latter.

11. Device according to claim 1, characterized in that the terminal element (710) is the output window.

12. Device according to claim 11, characterized in that the mounting means consist of a glued joint (794)

13. Device according to claim 1, characterized in that the focusing means comprise a terminal electrode (360) affixed to pre-terminal electrode (361) by means of electrically insulating fasteners (363).

14. Device according to claim 1, characterized in that an anti-reflection coating (374, 474) is in optical contact with the external face (341, 441) of the output window.

15. Device according to claim 14, characterized in that the anti-reflection coating (474) is applied directly onto the external face (441) of the output window.

16. Device according to claim 14, characterized in that the anti-reflection coating (374) is deposited on a face of an additional plate (373) that is transparent to the phosphor radiation, the additional plate (373) being in contact by its opposite parallel face with the external face of the output window by means of a second glue (372) having the same refractive index as the first glue (308).

17. Device according to claim 16, characterized in that the additional plate is made of glass.

18. Device according to claim 16, characterized in that the additional plate is made of plastics material.

19. Device according to claim 16, characterized in that the said additional plate is tinted.

20. Device according to claim 1, characterized in that the output window (604) is substantially thick.

21. Device according to claim 1, characterized in that substrate (351) for the phosphor (350) and/or output window is/are tinted.

22. Manufacturing process for a device for the chromatic conversion of an image obtained by electromagnetic radiation, and in particular for passing from ionizing radiation to visible light, in which process:

a) a vacuum envelope is formed, comprising:

an input window that is transparent to electromagnetic radiation, behind which is located a photoelectric input screen intended to receive the electromagnetic radiation, and an output window as well as focusing means joined to the vacuum envelope to focus photoelectrons emitted by the input screen toward an output window, b) a phosphor output screen is formed and affixed onto the internal face of the output window, characterized in that the envelope is formed of two elements, including one terminal element comprising the output window, and in that, in step b) the phosphor output screen is affixed to the internal face of the output window by means of a first glue having the same refractive index as the output window, and in that—the terminal element is made unitary with the rest of the envelope by vacuum-tight mounting means.

23. Process according to claim 22, characterized in that an anti-reflection coating is deposited in optical contact with the external face of the output window before the terminal element is made unitary with the rest of the envelope.

* * * * *